US009831576B2

(12) United States Patent
Wu et al.

(10) Patent No.: US 9,831,576 B2
(45) Date of Patent: Nov. 28, 2017

(54) TERMINAL, ELECTRICAL CONNECTOR AND ELECTRICAL CONNECTOR ASSEMBLY

(71) Applicant: Tyco Electronics (Shanghai) Co., Ltd., Shanghai (CN)

(72) Inventors: Shengyu Wu, Shanghai (CN); Wenke He, Shanghai (CN); Jiayong He, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/598,929

(22) Filed: Jan. 16, 2015

(65) Prior Publication Data

US 2015/0207256 A1 Jul. 23, 2015

(30) Foreign Application Priority Data

Jan. 17, 2014 (CN) ..... 2014 1 00228944

(51) Int. Cl.
*H01R 12/73* (2011.01)
*H01R 12/71* (2011.01)

(52) U.S. Cl.
CPC ..... *H01R 12/712* (2013.01); *H01R 12/73* (2013.01)

(58) Field of Classification Search
CPC ..... H01R 12/73; H01R 12/76; H01R 12/712; H01R 12/7011; H01R 43/18
USPC ..... 439/74, 357, 345, 626, 660
See application file for complete search history.

(56) References Cited

U.S. PATENT DOCUMENTS

| | | | | |
|---|---|---|---|---|
| 6,132,258 | A * | 10/2000 | Kajinuma | H01R 12/707 439/108 |
| 7,845,958 | B2 * | 12/2010 | Hoshino | H01R 13/6275 439/660 |
| 7,901,218 | B2 * | 3/2011 | Sato | H01R 13/20 439/74 |
| 8,408,931 | B2 * | 4/2013 | Sato | H01R 12/7052 439/357 |
| 9,147,969 | B2 * | 9/2015 | Takenaga | H01R 13/6275 |
| 9,178,309 | B2 * | 11/2015 | Tanaka | H01R 13/631 |
| 9,350,095 | B2 * | 5/2016 | Arichika | H01R 13/6271 |
| 9,543,675 | B1 * | 1/2017 | Takenaga | H01R 12/716 |
| 2005/0009383 | A1 * | 1/2005 | Okura | H01R 13/6275 439/74 |
| 2007/0010110 | A1 * | 1/2007 | Ono | H01R 12/67 439/74 |
| 2009/0280658 | A1 * | 11/2009 | Hoshino | H01R 13/6275 439/66 |
| 2013/0280926 | A1 * | 10/2013 | Ono | H01R 12/7052 439/65 |
| 2014/0099804 | A1 * | 4/2014 | Kobuchi | H01R 12/716 439/66 |

* cited by examiner

*Primary Examiner* — Amy Cohen Johnson
*Assistant Examiner* — Milagros Jeancharles
(74) *Attorney, Agent, or Firm* — Barley Snyder

(57) ABSTRACT

A socket connector terminal is disclosed having a terminal body, two contacts, and at least two welding portions. The two contacts are formed at opposite ends of the terminal body, each contact having a positioning portion that prevents movement in the socket connector along a plug connector insertion direction. The two welding portions are formed between the opposite ends of the terminal body, and are constructed to be welded to a circuit board.

16 Claims, 6 Drawing Sheets

TERMINAL, ELECTRICAL CONNECTOR AND ELECTRICAL CONNECTOR ASSEMBLY

CROSS-REFERENCE TO RELATED APPLICATION

This application claims priority under 35 U.S.C. 119(a)-(d) to Chinese Patent Application No. 201410022894.4, dated Jan. 17, 2014.

FIELD OF THE INVENTION

The invention is generally related to an electrical connector, and more specifically, to an electrical connector for connecting a circuit board to another circuit board.

BACKGROUND

In electronic devices, such as mobile phones, printers, digital and video cameras, GPS devices, panel computers, personal computers, and the like, for convenience in operation, two printed circuit boards (PCBs) are generally electrically connected by a board to board electrical connector. Such a connection is used to transmit electrical power and data signals between the two PCBs.

However, these conventional electrical connectors are limited to a low levels of current, such as 2 amps. Therefore, the conventional electrical connectors are unable to meet the high transmission current demands required in modern electrical devices, such as mobile communication devices and the like.

There is a need for an electrical connector for connecting two PCBs that permits high levels of transmission current.

SUMMARY

A socket connector terminal has a terminal body, two contacts, and at least two welding portions. The two contacts are formed at opposite ends of the terminal body, each contact having a positioning portion that prevents movement in the socket connector along a plug connector insertion direction. The two welding portions are formed between the opposite ends of the terminal body, and are constructed to be welded to a circuit board.

BRIEF DESCRIPTION OF THE DRAWINGS

The invention will now be described by way of example, with reference to the accompanying Figures, of which.

DETAILED DESCRIPTION OF PREFERRED EMBODIMENT(S)

Figure 1:
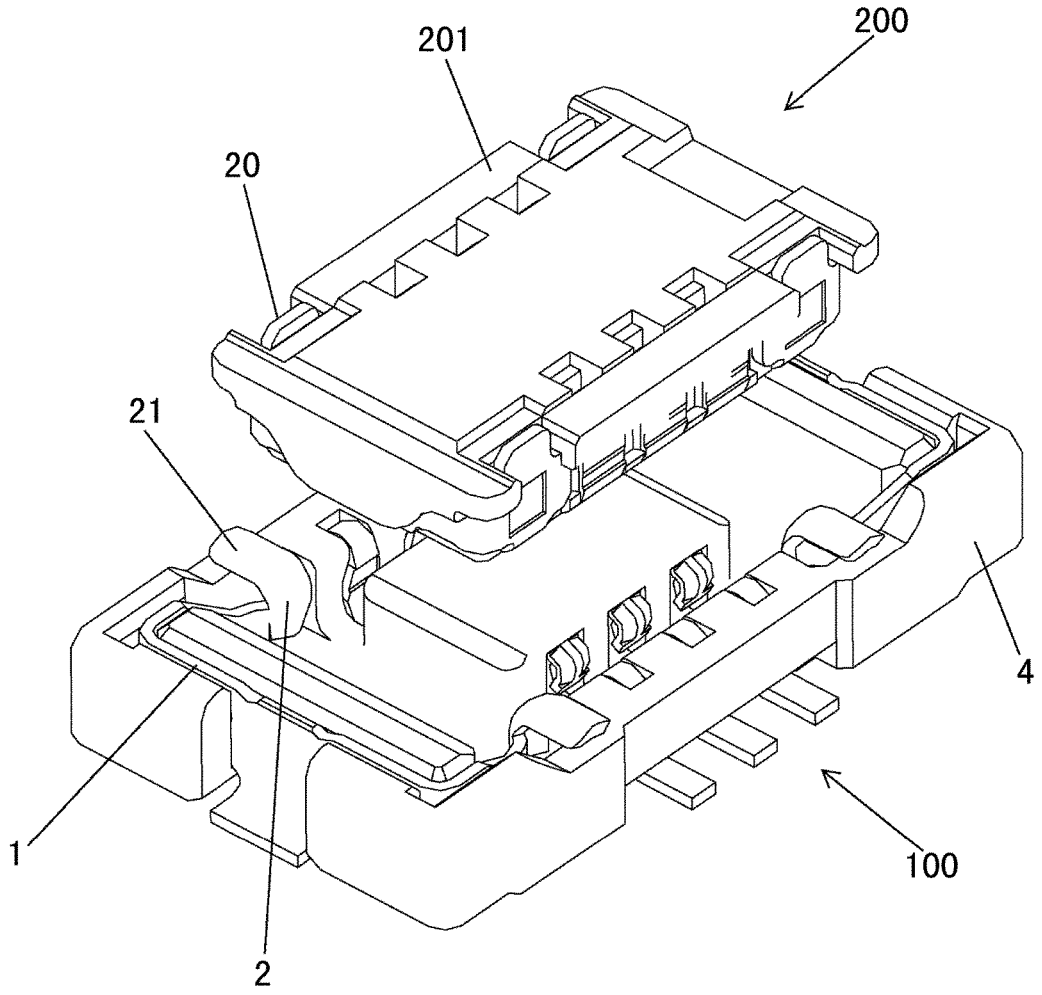
FIG. 1 is an exploded view of an electrical connector assembly.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An electrical connector assembly, as shown in FIG. 1, has a socket connector 100 and a plug connector 200 mounted on two circuit boards, respectively. The two exemplary circuit boards, which may be two printed circuit boards (PCBs), are electrically connected by the socket connector 100 and the plug connector 200, so as to transmit an electric power and data signals between the two circuit boards.

In the embodiments of FIGS. 1-7, the socket connector 100 is mounted on a circuit board 300. The socket connector 100 comprises a housing 4 and two terminals 10 mounted in the housing 4. The terminals 10 are used as power terminals for power signal transmission. In an embodiment, the housing 4 may be made of insulation material and include a plug connector receiving space 41. In an embodiment of FIG. 4, the plug connector receiving space 41 is defined by an external frame of the socket connector 100 and configured to receive the plug connector 200 therein.

Figure 2:
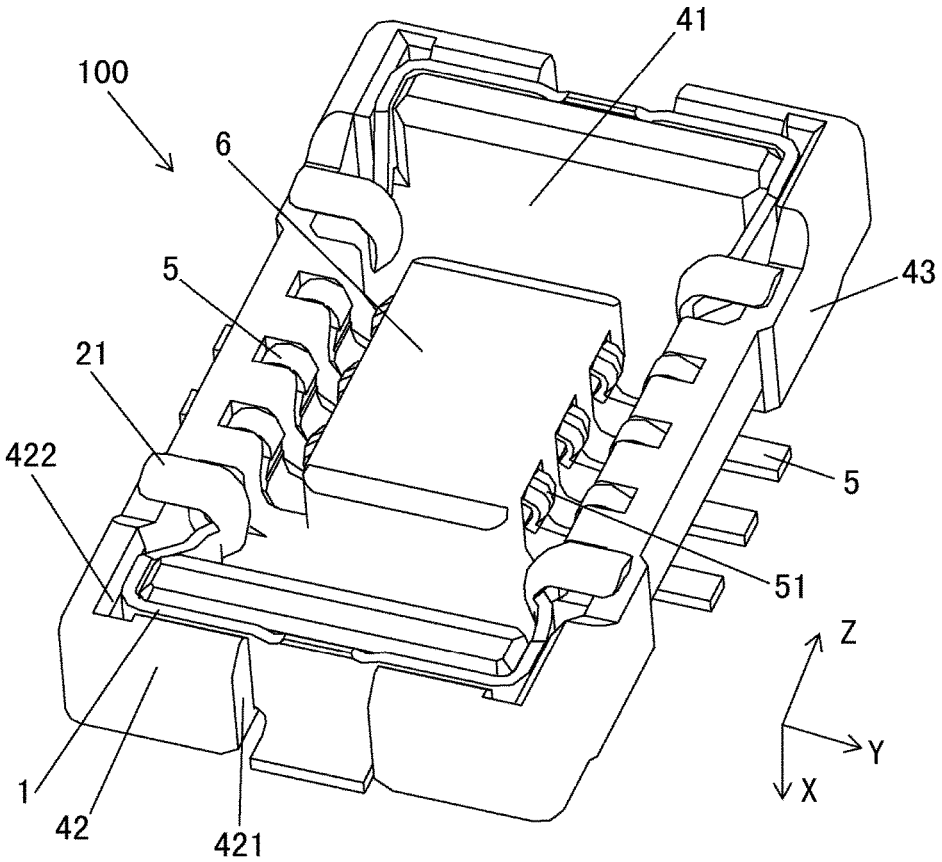
FIG. 2 is a perspective view of a socket connector.
Figure 6:
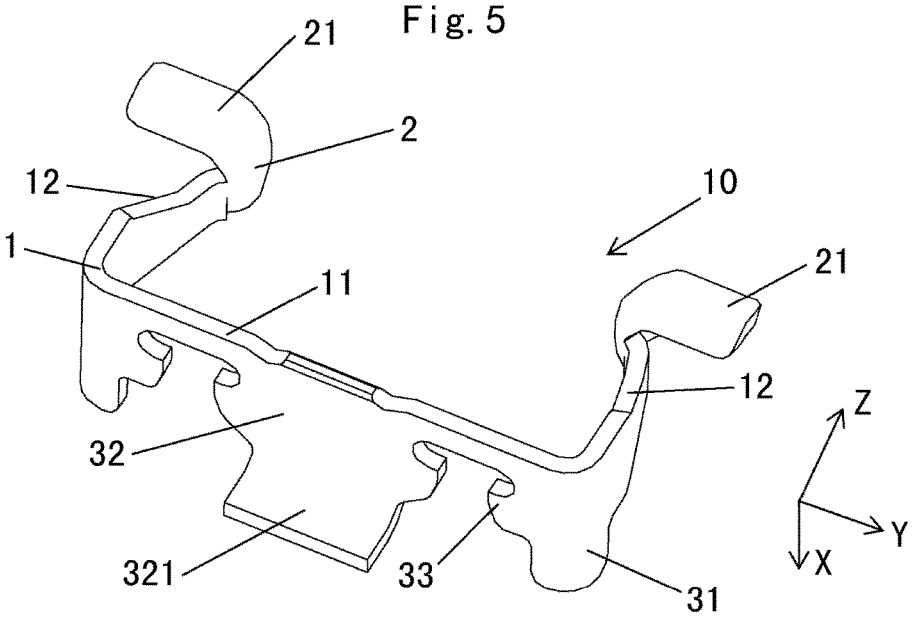
FIG. 6 is a front perspective view of a terminal.
Figure 7:
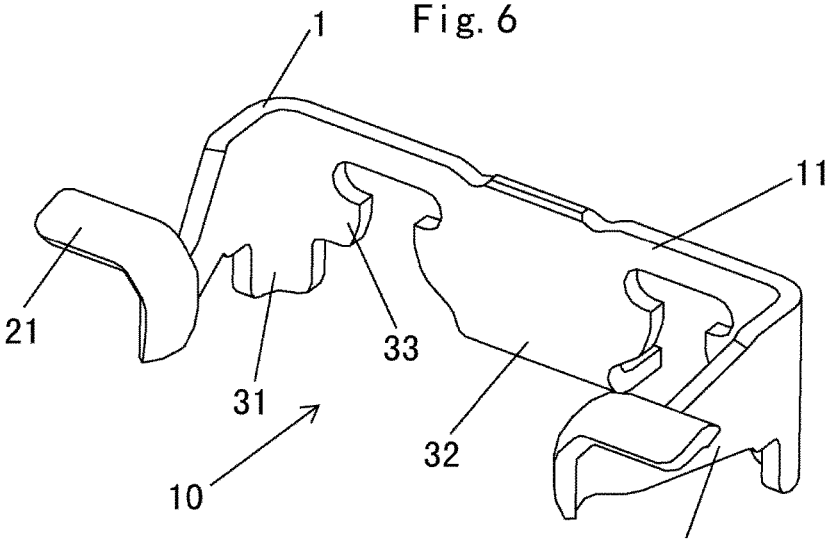
FIG. 7 is a rear perspective view of the terminal shown in FIG. 6.
Figure 8:
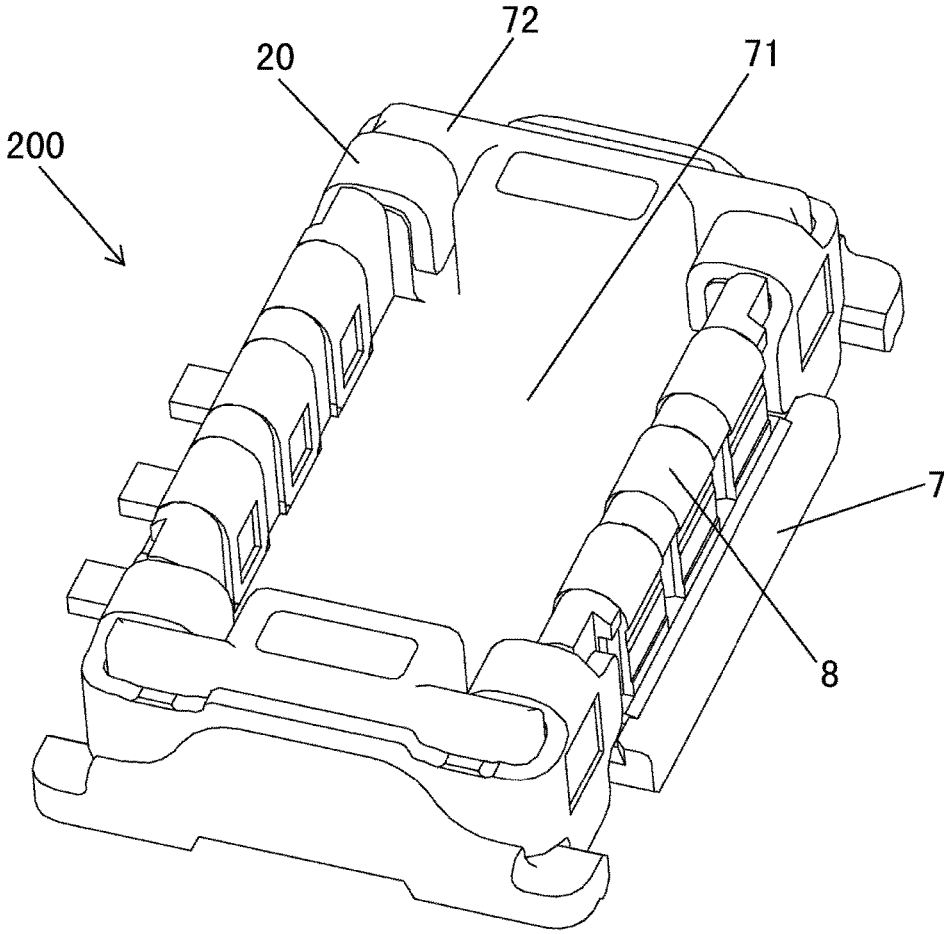
FIG. 8 is a perspective view of a plug connector.
Figure 9:
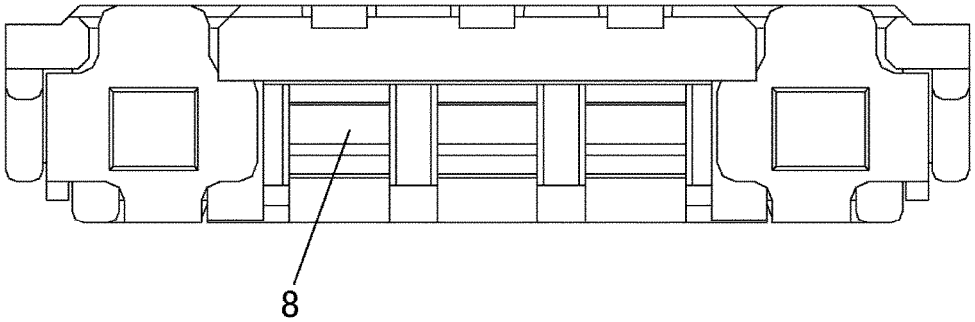
FIG. 9 is a perspective side view of the plug connector shown in FIG. 8, taken along a longitudinal direction.

In the embodiments of FIGS. 2, 6 and 7, each terminal 10 has a bent terminal body 1 positioned in the external frame of the socket connector 100 defining the plug connector receiving space 41, from an upper shoulder of the housing 4. The terminal body 1 may be formed from a conductive metal sheet. Two contacts 2 are formed at two opposite ends of the terminal body 1, each contact 2 extending a distance into the plug connector receiving space 41. At least two welding portions (not labeled) are formed between the two ends of the terminal body 1 and extend out from a base of the housing 4 to be welded on a circuit board. Each contact 2 is formed with a positioning portion 21 which abuts against the upper shoulder of the external frame of the socket connector 100, so as to prevent the contacts 2 from moving in the housing 4, along an insertion direction X of a plug connector 200.

In an embodiment of FIGS. 2, 6 and 7, the terminal body 1 has a terminal base 11 extending inward from the external frame of the socket connector 100. Two extension arms 12 of the terminal 10 are positioned at opposite ends of the terminal base 11, respectively, by bending. Each extension arm 12 abuts against an inward facing side of the external frame of the socket connector 100. The contacts 2 are formed on a free end of each extension arm 12, respectively.

In an embodiment, the external frame of the socket connector 100 has a substantial rectangle shape and includes two connecting walls 42 positioned on opposite ends of two longitudinal walls 43, and extending therebetween. The terminal body 1 is approximately U-shaped, and the terminal base 11 extends in a lateral direction Y (see FIGS. 2 and 6) perpendicular to the insertion direction X (see FIGS. 2 and 6). The terminal base 11 is mounted along the connecting walls 42, extending in the lateral direction Y between the two longitudinal walls 43. The two extension arms 12 extend from both ends of the terminal base 11, respectively, in a longitudinal direction Z (see FIGS. 2 and 6) substantially perpendicular to the insertion direction X and the lateral direction Y. Each of the extension arms 12 abuts against an inward facing side of the respective longitudinal wall 43, and the contacts 2 are formed on free ends of the extension arms 12. The contacts 2 are formed on inner facing sides of the extension arms 12.

As described above, the terminal body 1 is approximately U-shaped, but the present invention is not limited to this. In other embodiments, the extension arm 12 may extend parallel to the terminal base 11; each of the extension arms 12 may abut against an inner side of the respective connecting wall 42; the contacts 2 may be formed on free ends of the extension arms 12, respectively; or the positioning portion 21 may be constructed to abut against the upper shoulder of the connecting wall 42.

Figure 3:
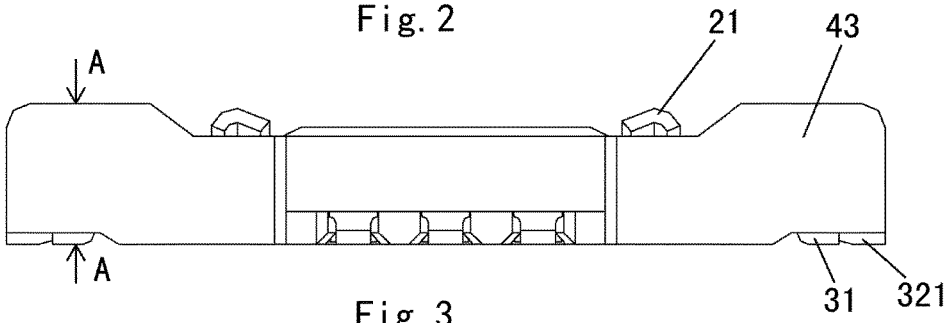
FIG. 3 is a perspective side view of the socket connector shown in FIG. 2, taken along a longitudinal direction.

In an embodiment, the positioning portion 21 extends outward, perpendicular to the insertion direction X, from an outer facing side of the contact 2. In this way, as shown in the embodiments of FIGS. 2-3, during insertion of a plug connector 200 into the socket connector 100, a mating terminal 20 of the plug connector 200 presses against the contact 2 of the terminal 10. The contact 2 of the terminal 10 is laterally and outwardly offset in a state shown in FIG. 2. The frictional force exerted by the plug connector 200 against the contact 2 displaces the contact 2 in the insertion direction X (see FIG. 2). However, since the positioning portion 21 abuts against the upper shoulder of the longitudinal wall 43, the positioning portion 21 prevents the contact 2 from moving downward, ensuring a good electrical connection between the terminal 10 of the socket connector 100 and the mating terminal 20 of the plug connector 200.

In an embodiment of FIG. 3, the positioning portion 21 has a substantially arched cross section whereby the apex of the arched cross section is positioned the furthest from the longitudinal wall 43, that is, the positioning portion 21 has a substantially convex shape. In this way, the positioning portion 21 has a certain elasticity relative to the longitudinal wall 43, so as to prevent the positioning portion 21 from undergoing an unrecoverable deformation under the pressing force of the mating terminal 20 of the plug connector 300.

In an embodiment of FIGS. 6-7, a welding portion 32 of the terminal 10 include two first welding feet 31 extending from two opposite joints formed at the intersection of the terminal base 11 and the extension arms 12. The welding portion 32 further includes a second welding portion positioned between the opposite ends of the terminal base 11, and extending in the insertion direction X. The second welding portion includes a substantially flat, high current contact 321 for transmitting high current. The two first welding portions 31 have a pin structure.

Figure 4:
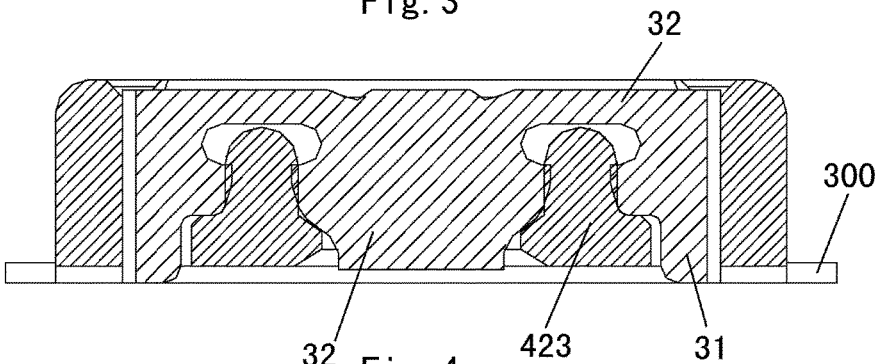
FIG. 4 is a cross sectional view of the socket, taken along a line A-A shown in FIG. 3, showing a terminal and a circuit board.
Figure 5:
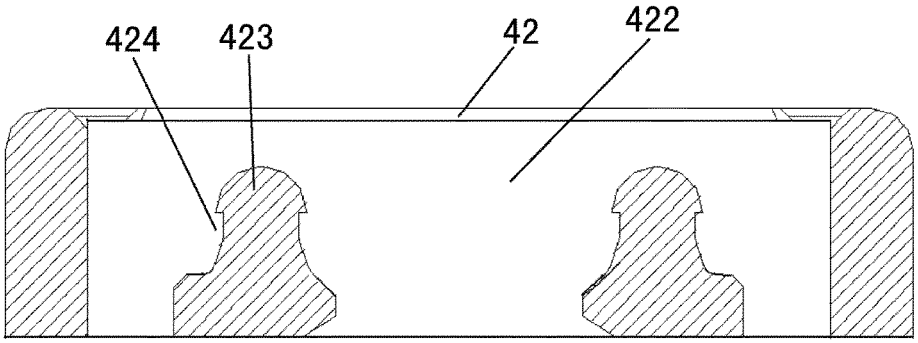
FIG. 5 is a cross sectional view of the socket connector taken in a line A-A shown in FIG. 3, without the terminal and the circuit board shown in FIG. 4.

In the embodiments of FIGS. 3 and 4, the first welding portions 31 may be inserted into complementary holes disposed in the circuit board 300. The high current contact 321 of the second welding portion 32 may be electrically connected on a plane contact disposed on a surface of the circuit board 300. Optionally, at least one first welding portion 31 and the second welding portion 32 may have the pin structure or the flat structure.

Consequently, the two contacts 2 and the three welding portions 32, 321 can transmit a high current of, for example, about 5 A, thus improving the current transmission ability between circuit boards.

In the embodiments of FIGS. 1 and 2, a recess 421 is formed in the connecting wall 42, and the high current contact 321 of the second welding portion 32 is positioned in the recess 421. In this way, when the terminal 10 is mounted in the housing 4, the high current contact 321 is positioned in the recess 421.

In the embodiments of FIGS. 2-7, the terminal 10 includes at least one elastic locking member 33 formed between the first welding portion 31 and the second welding portion 32. The elastic locking member 33 extends inward, towards the high current contact 321. Correspondingly, a terminal base receiving space 422 is formed in the connecting wall 42. A partitioning wall 423 is formed in the terminal base receiving space 422 and includes at least one terminal receiving recess 424. The elastic locking member 33 of the terminal 10 is positioned into the respective terminal receiving recess 424 in a snapping manner. Consequently, when the terminal 10 is mounted in the housing 4, each elastic locking member 33 is engaged into the respective terminal receiving recess 424 in the snapping manner. As such, the terminal 10 is reliably fixed in the housing 4 and cannot be moved by the mating terminal 20 during plugging the plug connector 200 in or out of the socket connector 100.

In an embodiment of FIG. 2, the socket connector 100 includes a protruding platform 6 positioned in an approximate middle of the plug connector receiving space 41, extending out of a base wall (not labeled, see line for callout number 41) of the housing 4. An outer peripheral edge of the protruding platform 6 is positioned a distance from the inward facing sides of the connecting walls 42 and the longitudinal walls 43 of the socket connector 100 to form a plug connector frame receiving space (not labeled) therebetween.

In an embodiment, the socket connector 100 has a plurality of data terminals 5 mounted in the plug connector receiving space 41, for transmitting data signals. A plurality of springs 51 are mounted in at least one side of the protruding platform 6. The springs 51 may be configured to electrically connect the data terminals 5.

In the embodiments of FIGS. 1-8, the plug connector 200 has a housing 7, two mating terminals 20, and a plurality of mating data terminals 8 mounted in the housing 7. In an embodiment, the housing 7 is formed from an insulating material and has a socket connector receiving space 71 defined by an external plug connector frame 72. When the plug connector 200 is positioned into the socket connector 100, the protruding platform 6 of the socket connector 100 is received in the socket connector receiving space 71 of the plug connector 200, and the external frame 71 of the plug connector 200 is received in the plug connector frame receiving space between the protruding platform 6 and the lateral and longitudinal walls 42, 43 of the socket connector 100. The terminals 10 and the data terminals 5 of the socket connector 100 electrically contact and connect the mating terminals 20 and the mating data terminals 8 of the plug connector 200. In this way, one circuit board, on which the socket connector 100 is mounted, is electrically connected to another circuit board, on which the plug connector 200 is mounted.

Figure 10:
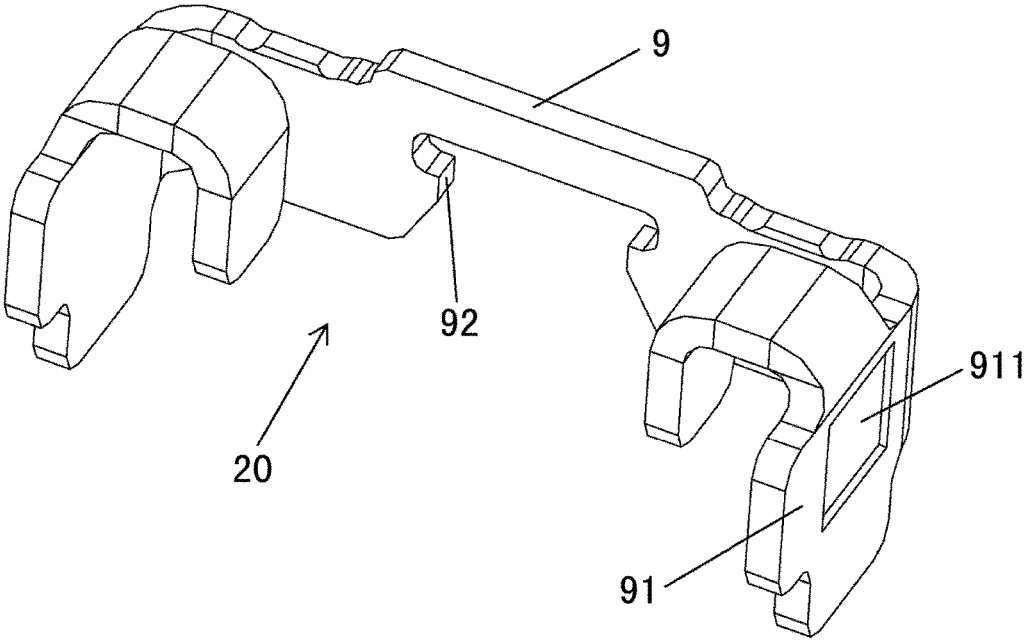
FIG. 10 is a top perspective view of a mating terminal of the plug connector.
Figure 11:
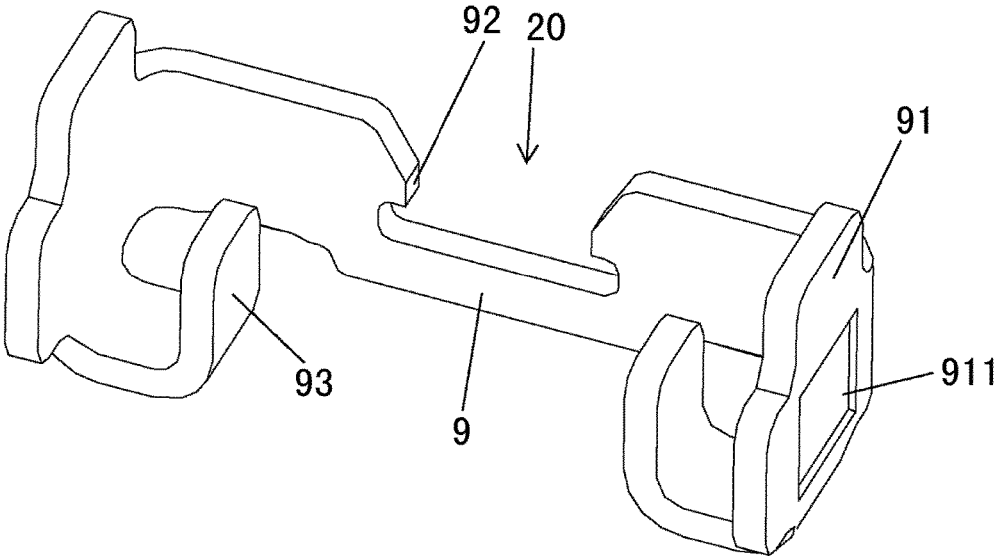
FIG. 11 is bottom perspective view of the mating terminal shown in FIG. 10.
Figure 12:
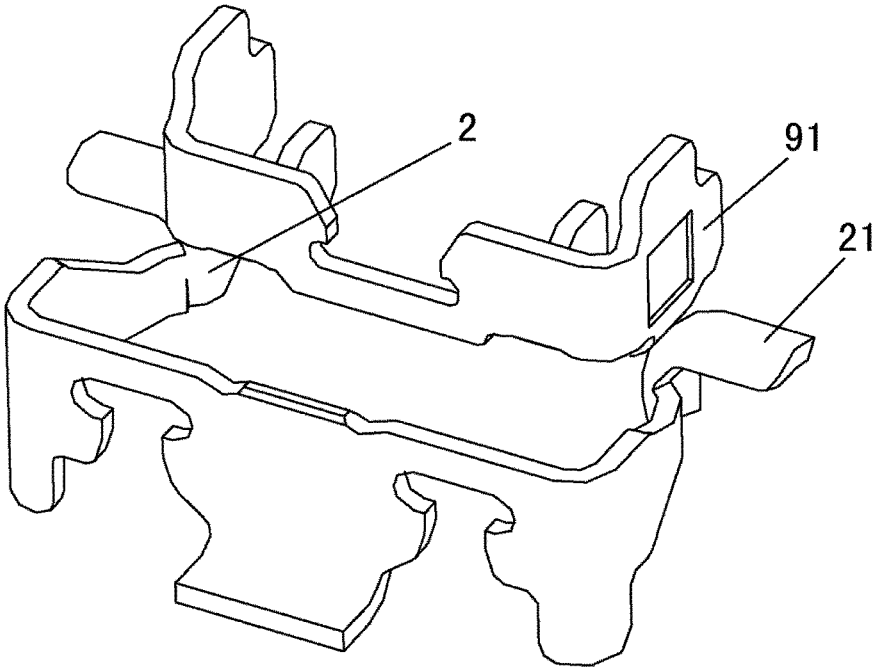
FIG. 12 is a front perspective view of the terminal of the socket connector and the mating terminal of the plug connector.
Figure 13:
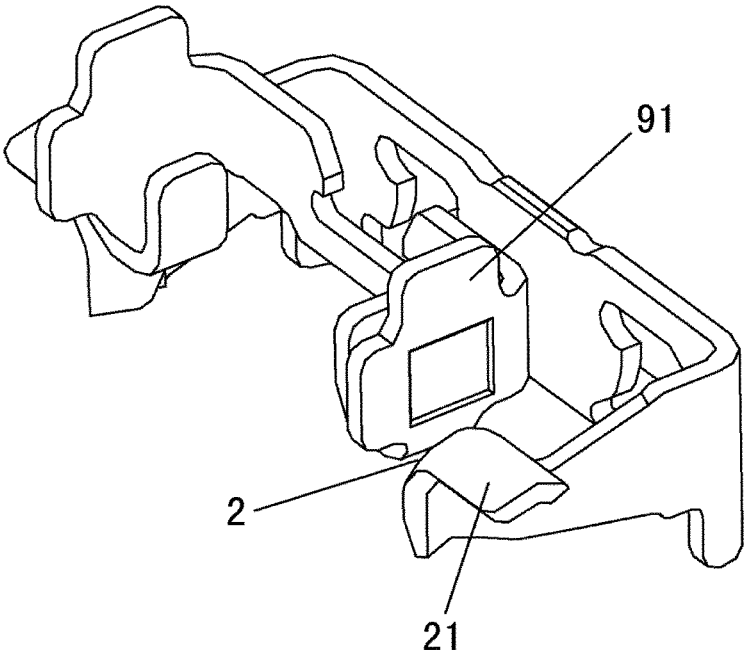
FIG. 13 is a rear perspective view of the terminal of the socket connector and the mating terminal of the plug connector.

In the embodiments of FIGS. 8-13, the mating terminals 20 and the mating data terminals 8 are partly embedded in the external plug connector frame 72. In the embodiments of FIGS. 10-11, the mating terminal 20 has a mating body 9 made from a conductive sheet, and mounted in the external plug connector frame 72 from an upper shoulder of the housing 7. Two mating contacts 91 are formed at two opposite ends of the mating body 9, respectively. Each mating contact 91 is formed with a positioning member 93. The positioning member 93 is bent into an approximate U-shape and extends from outside of the external plug connector frame 72 to bend over the external plug connector frame 72, and extends inward over an inward facing surface of the external plug connector frame 72. (See FIG. 8) In an embodiment, a recess 911 is formed in the mating contact 91. The protruding contact 2 of the terminal 10 is positioned in the recess 911, so as to ensure a good electrical connection between the mating contact 91 of the mating terminal 20 and the contact 2 of the terminal 10. The mating terminal 20 is may be formed with a spring 92 thereon, so as to reliably hold the mating terminal 20 in the housing 7.

In an embodiment of FIG. 1, when the plug connector 200 is engaged with the socket connector 100, the protruding platform 6 of the socket connector 100 is received in the socket connector receiving space 71 of the plug connector 200. The external frame 71 of the plug connector 200 is received in the plug connector frame receiving space positioned between the protruding platform 6 and the connecting and longitudinal walls 42, 43 in the socket connector 100.

In an embodiment, the terminal 10 and the mating terminal 20 each may be made of a single conductive metal sheet, such as a copper sheet, by cutting, punching, bending or other suitable processes.

In an embodiment, a terminal 10 may be mounted in a housing 4 of a socket connector 100. The terminal 10 includes a bent terminal body 1 made of conductive sheet; two contacts 2 formed at two opposite ends of the terminal body 1, respectively; and at least two welding portions 3 formed between the two opposite ends of the terminal body 1 and constructed to be welded to a circuit board 300. Each contact 2 has a positioning portion 21 that prevent the contacts 2 from moving in the housing 4 of the socket connector 100 in an insertion direction X of a plug connector 200.

In an embodiment, the terminal 10 includes the terminal body 1 that has a substantially U-shape. The terminal body 1 includes a terminal base 11 and two extension arms 12. The terminal base 11 extends in a lateral direction Y perpendicular to the insertion direction X. The two extension arms 12 extend from the two opposite ends of the terminal base 11, respectively, in a longitudinal direction Z substantially perpendicular to the insertion direction X and the lateral direction Y. The contacts 2 are formed on inward facing surfaces of the extension arms 12, respectively.

In the above disclosed embodiments, since the positioning portion abuts against the upper shoulder of the longitudinal wall of the socket connector 100, the positioning portion prevents the contact from moving downward, ensuring a good electrical connection between the terminal of the socket connector and a mating terminal of a plug connector. Accordingly, the terminal can transmit high current, improving the current transmission ability of the board to board type connector. The terminal is reliably fixed in the housing and cannot be moved by the mating terminal during plugging the plug connector in or out of the socket connector.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A socket connector terminal comprising:

a terminal body having a terminal base and an extension arm bent from each opposite end of the terminal base;

two contacts, each contact formed on a free end of one extension arm and having a positioning portion that prevents movement in a socket connector along a plug connector insertion direction;

at least two welding portions formed between the opposite ends of the terminal body, and being constructed to be welded to a circuit board, the two welding portions including two first welding feet extending in the insertion direction from two opposite joints formed at an intersection of the terminal base and each extension arm, and a second welding portion positioned between the opposite ends of the terminal base and extending in the insertion direction; and a pair of opposing elastic locking members formed on the terminal base.

2. The socket connector terminal of claim 1, wherein:

the terminal body has an approximate U-shape;

the terminal base extends perpendicular to the insertion direction;

one extension arm extends longitudinally from each of the opposite ends of the terminal base, being substantially perpendicular to the insertion direction; and each contact is formed on an inward facing side of each extension arm.

3. The socket connector terminal of claim 1, wherein each positioning portion extends outward from an outer facing side of the contact, substantially perpendicularly to the insertion direction.

4. The socket connector terminal of claim 1 wherein the second welding portion includes a high current contact.

5. The socket connector terminal of claim 1, wherein the socket connector terminal is a power terminal for power transmission.

6. A circuit board mounted socket connector comprising:
a housing having a plug connector receiving space defined by an external frame; and
a terminal comprising:
a terminal body positioned in the external frame from an upper shoulder of the housing, the terminal body having a terminal base and an extension arm bent from each opposite end of the terminal base,
two contacts, each contact formed on a free end of one extension arm, extending a distance into the plug connector receiving space, and having a positioning portion which abuts against the upper shoulder of the external frame to prevent contact movement in the housing in an insertion direction,
at least two welding portions formed between the two opposite ends of the terminal body and extending out from a base of the housing, the two welding portions including two first welding feet extending in the insertion direction from two opposite joints formed at an intersection of the terminal base and each extension arm, and a second welding portion positioned between the opposite ends of the terminal base and extending in the insertion direction, and
a pair of opposing elastic locking members formed on the terminal base.

7. The socket connector of claim 6, wherein the terminal base is mounted along the external frame; and
each extension arm abuts against an inward facing side of the external frame.

8. The socket connector of claim 6, wherein:
the external frame includes two connecting walls positioned on opposite ends of two longitudinal walls, and extending therebetween;
the terminal body is approximately U-shaped;
the terminal base extends perpendicular to the insertion direction and is mounted along the connecting walls;
the two extension arms extend from opposite ends of the terminal base, substantially perpendicular to the insertion direction; and
the contacts are formed on inner facing surfaces of each extension arm.

9. The socket connector of claim 8, wherein the second welding portion includes
a recess formed in the connecting wall; and
a high current contact is positionable in the recess.

10. The socket connector of claim 8, wherein,
a terminal base receiving space is formed in the connecting wall and receives the terminal base of the terminal therein;
a partitioning wall is formed in the terminal base receiving space and includes at least one terminal receiving recess; and
each elastic locking member is positioned into the respective terminal receiving recess in a snapping manner.

11. The socket connector of claim 6, wherein each positioning portion extends outward from an outer facing side of the contact, substantially perpendicularly to the insertion direction.

12. The socket connector of claim 11, wherein the positioning portion has a substantially arched cross section whereby the apex of the arched cross section is positioned further from the longitudinal wall.

13. The socket connector of claim 6, further comprising:
a protruding platform positioned in an approximate middle of the plug connector receiving space, extending out of a base wall of the housing; and
an outer peripheral edge of the protruding platform is positioned a distance from the inward facing sides the external frame to form a plug connector frame receiving space.

14. The socket connector of claim 13, further comprising:
a plurality of data terminals mounted in the external frame.

15. The socket connector according to claim 14, wherein a plurality of springs are mounted in at least one side of the protruding platform.

16. An electrical connector assembly, comprising:
a socket connector having a housing having a plug connector receiving space defined by an external frame; and
a terminal comprising:
a terminal body positioned in the external frame from an upper shoulder of the housing, the terminal body having a terminal base and an extension arm bent from each opposite end of the terminal base,
two contacts, each contact formed on a free end of one extension arm, extending a distance into the plug connector receiving space, and having a positioning portion which abuts against the upper shoulder of the external frame to prevent contact movement in the housing in an insertion direction,
at least two welding portions formed between the two opposite ends of the terminal body and extending out from a base of the housing, the two welding portions including two first welding feet extending in the insertion direction from two opposite joints formed at an intersection of the terminal base and each extension arm, and a second welding portion positioned between the opposite ends of the terminal base and extending in the insertion direction, and
a pair of opposing elastic locking members formed on the terminal base; and
a plug connector mated with the socket connector, having a complementary mating terminal connected to the terminal of the socket connector.

* * * * *